US006601838B1

(12) United States Patent
Gilley

(10) Patent No.: US 6,601,838 B1
(45) Date of Patent: Aug. 5, 2003

(54) CLAMP FOR USE IN WOOD FRAMING

(76) Inventor: Michael Reece Gilley, 7199 Hampton Rd., Clemmons, NC (US) 27102

( * ) Notice: Subject to any disclaimer, the term of this patent is extended or adjusted under 35 U.S.C. 154(b) by 17 days.

(21) Appl. No.: 09/696,371

(22) Filed: Oct. 25, 2000

Related U.S. Application Data

(60) Provisional application No. 60/161,610, filed on Oct. 26, 1999.

(51) Int. Cl.[7] ..... B25B 7/14

(52) U.S. Cl. ..... 269/37; 269/6; 269/228; 81/420; 81/421; 81/367; 81/368

(58) Field of Search ..... 269/41, 37, 228, 269/282, 6; 29/268; 81/420, 421, 367, 368, DIG. 1

(56) References Cited

U.S. PATENT DOCUMENTS

| | | | | | |
|---|---|---|---|---|---|
| 545,304 | A | * | 8/1895 | Nelson | 81/426 |
| 1,883,081 | A | * | 10/1932 | Sturm | 81/420 |
| 4,088,313 | A | | 5/1978 | Pearson | |
| 4,114,482 | A | | 9/1978 | Houdeshell | |
| 4,183,144 | A | | 1/1980 | Barnett, III | |
| 4,238,123 | A | | 12/1980 | Bardes | |
| 4,505,011 | A | * | 3/1985 | Dupuy | 81/420 |
| 4,559,853 | A | * | 12/1985 | Oye | 81/426 |
| 4,696,460 | A | | 9/1987 | Genereaux et al. | |
| 4,957,257 | A | | 9/1990 | Gonzalez | |
| 5,052,251 | A | * | 10/1991 | Mills | 81/324 |
| 5,351,585 | A | | 10/1994 | Leesberg et al. | |
| 5,482,263 | A | | 1/1996 | Kutzleb | |
| 5,575,518 | A | * | 11/1996 | Payne | 269/41 |
| 5,863,033 | A | | 1/1999 | Bradford | |
| 5,902,015 | A | * | 5/1999 | Allcock | 81/420 |
| 5,931,453 | A | | 8/1999 | Brennan | |
| 6,175,998 | B1 | * | 1/2001 | Leo | 81/420 |

* cited by examiner

*Primary Examiner*—Robert C. Watson
(74) *Attorney, Agent, or Firm*—Robert W. Pitts

(57) ABSTRACT

A clamp or locking pliers of this invention are intended for positioning aligning a first wooden framing member transversely relative to a second wooden framing member prior to attachment of the first wooden framing member to the second wooden framing member. The clamp includes a first gripping jaw and a second gripping jaw. The first and second jaws are shiftable toward each other to grip the first wooden member. A crossbar extends transversely, preferably at right angles, relative to the first and second gripping jaws for supporting the first wooden framing member on the second wooden framing member and for mutually aligning the two members so that they can be nailed together. A safety guard on the locking pliers includes a bail that can be rotated to prevent release of a locking pliers release clip so that the pliers can be used to hoist a wooden framing member.

8 Claims, 10 Drawing Sheets

CLAMP FOR USE IN WOOD FRAMING

CROSS REFERENCE TO PRIOR PENDING PROVISIONAL PATENT APPLICATION

This application claims the benefit of prior Provisional Patent Application No. 60/161,610 filed Oct. 26, 1999.

BACKGROUND OF THE INVENTION

1. Field of the Invention

This invention is related to locking pliers or clamps and to their use in wood framing or similar applications. The preferred embodiment is a over center locking pliers that includes a transverse aligning member or crossbar that is used to align and support a member gripped by the locking pliers with another member so that the two can be attached. The invention is also related to the use of a safety guard to prevent inadvertent release of the locking clip.

2. Description of the Prior Art

Locking pliers, clamps or toggle linkage gripping tools are used for a variety of applications in which two members must be temporarily clamped together before being permanently attached. These prior art tools tend to fall into one of three types. The first is intended to be used to grip a member so that it can be manipulated. U.S. Pat. No. 5,351,585 is an example of a tool of this type. The second are intended to hold two large members, such a wood frame members, at right angles before they are nailed together. U.S. Pat. No. 4,238,123 is and example, but that device can only be used to hold the butt end of one member in engagement with another. A third group, as exemplified by U.S. Pat. No. 4,696,460, provides for adjustment, but are rather complex tools that are unsuitable for use in field construction. Other clamping tools include U.S. Pat. No. 4,088,313; U.S. Pat. No. 4,114,482; U.S. Pat. No. 4,957,257; U.S. Pat. No. 5,482,263; U.S. Pat. No. 5,863,033; and U.S. Pat. No. 5,931,453.

SUMMARY OF THE INVENTION

Although not limited to use in performing only wood framing, the instant invention is of particular value when used in wood frame construction.

One of the objects of this invention is to provide a tool that can be used by a carpenter to more efficiently perform typical wood framing tasks. Use of this tool will even permit a single carpenter to perform tasks that would otherwise require the assistance of a second worker to temporarily support and align framing members, such as rafters or sheathing, prior to permanent attachment.

Another object of this invention is to provide a tool that will assist a carpenter in mounting framing members at a elevated position on a wood frame structure. The clamp or locking pliers provides a means for hoisting framing members into place on a construction site.

The clamp or locking pliers of this invention are intended for positioning and aligning a first wooden framing member transversely relative to a second wooden framing member prior to attachment of the first wooden framing member to the second wooden framing member. The clamp includes a first gripping jaw and a second gripping jaw. The first and second jaws are shiftable toward each other to grip the first wooden member. A crossbar extends transversely, preferably at right angles, relative to the first and second gripping jaws for supporting the first wooden framing member on the second wooden framing member and for mutually aligning the two members so that they can be nailed together.

DETAILED DESCRIPTION OF THE PREFERRED EMBODIMENT

Figure 1:
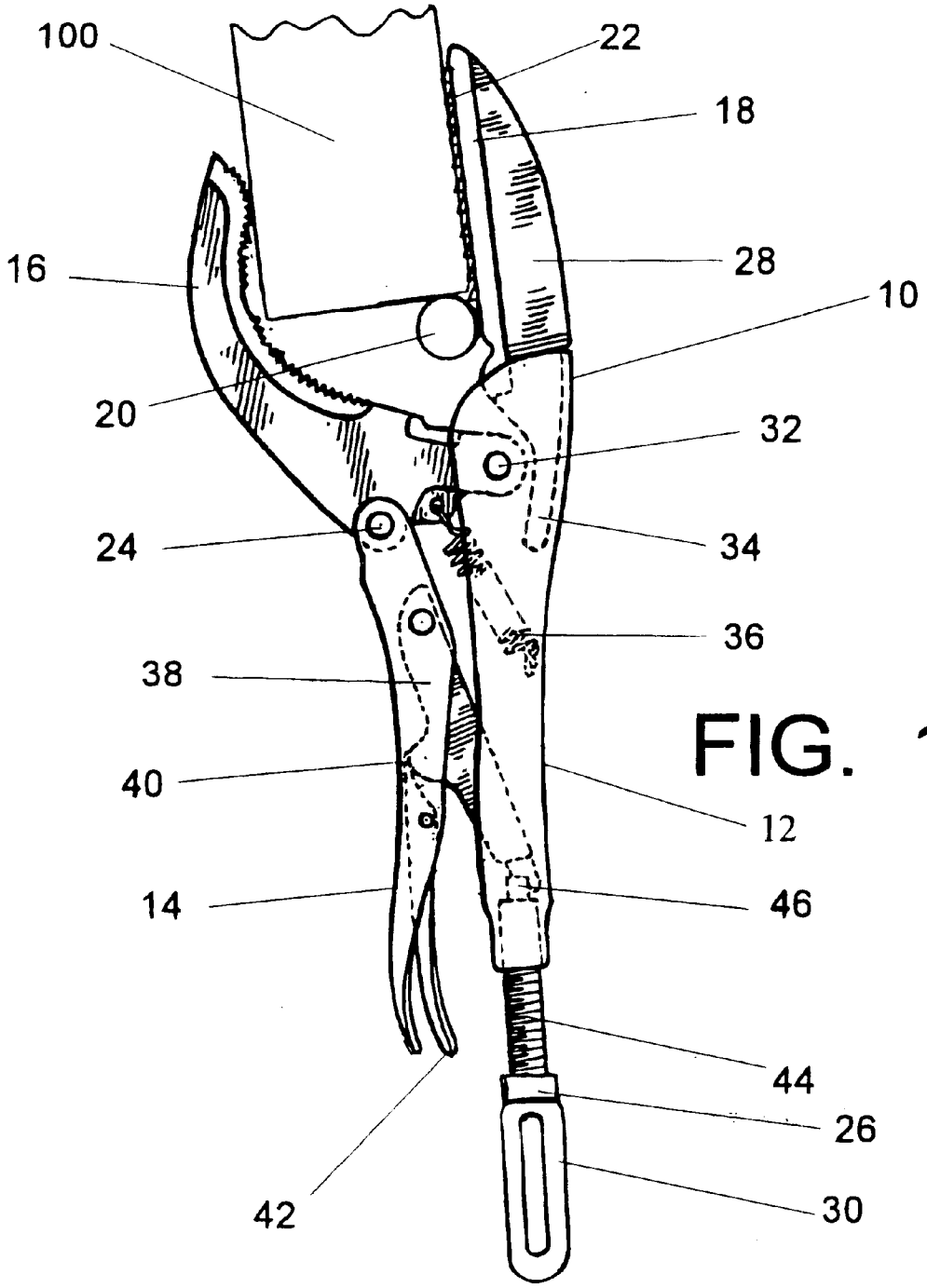
FIG. 1 is a side view of the clamp or locking pliers comprising the preferred embodiment of this invention showing the manner in which a member, such as a wood plank, with a rectangular cross section is gripped by a flat clamping jaw when the rectangular member abuts a cylindrical crossbar located on the locking pliers.
Figure 2:
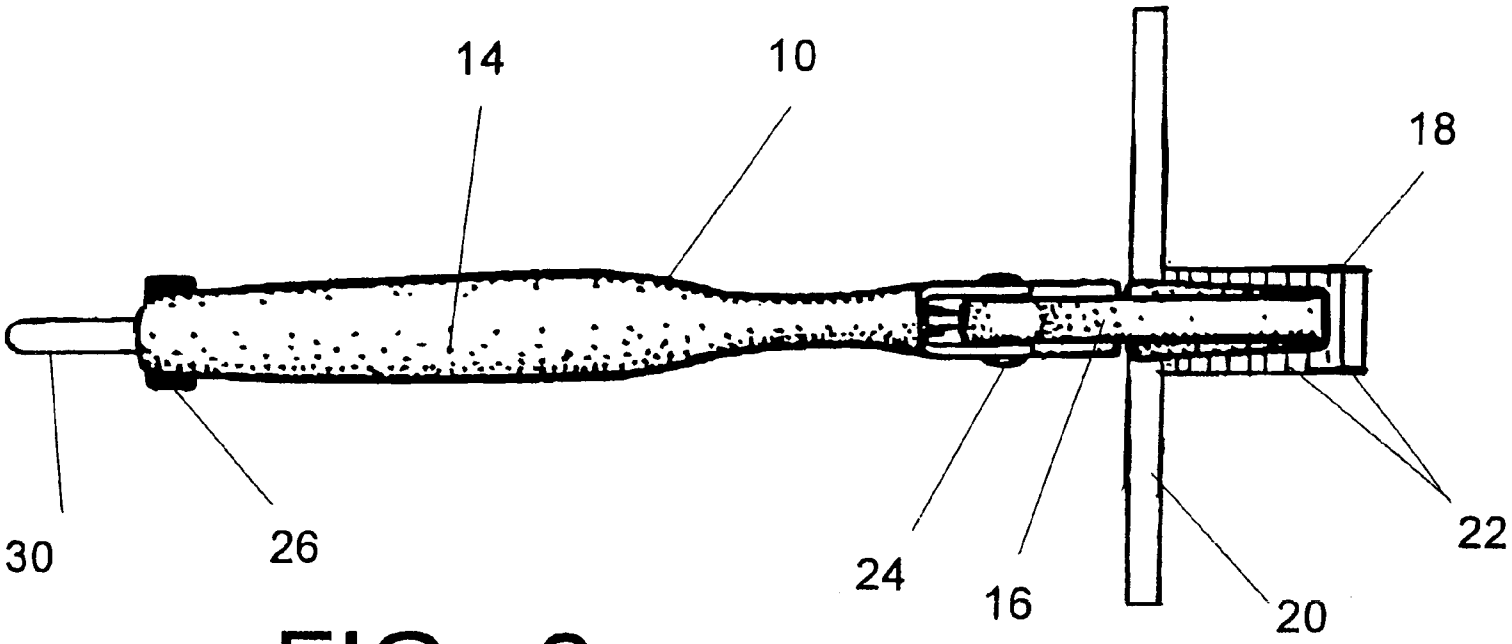
FIG. 2 is a top view of the locking pliers shown in FIG. 1 showing the top surface of the flat jaw and the crossbar extending generally perpendicular to the axis of the locking pliers.

FIGS. 1 and 2 show the clamp or locking pliers 10 that comprise the preferred embodiment of this invention. FIGS. 3–7 depict the manner in which the locking pliers 10 can be used in wood framing applications such as the construction of a house and in the construction of a roof. It would of course be apparent to one of ordinary skill in the art that the preferred embodiment of the locking pliers or clamp 10, and its components as depicted herein, must be of sufficiently sturdy construction to support the typical loads encountered in such application. However, a tool having the basic features of this locking pliers or clamp 10 can also be used for applications that do not require the same load bearing characteristics.

Locking pliers 10 include a body which is fixedly secured to a fixed jaw 28. The fixed or lower jaw 28 defines a first working or gripping surface 18 which is substantially flat with a series of protruding tangs 22 for gripping a wood frame member, a plank or some other workpiece 100, preferably having a rectangular cross section.

The body defines a pivot axis or hinge 32 which is fixed in place on the body, and a movable or upper jaw 16 is mounted to pivot around the pivot axis of hinge 32. The movable jaw 16 defines a second working surface or gripping surface for gripping a wooden member or other workpiece between the two jaws. This upper gripping surface is curved and opposes the flat gripping surface on the fixed jaw.

The position of the movable jaw 16 with respect to the fixed jaw 28 is controlled by a an over-center toggle linkage 38 which both pivots the movable jaw 16 with respect to the body and the fixed jaw 28 and locks the movable jaw 16 in position. The over-center toggle linkage 38 includes a lever or handle 14 that is pivoted to the movable jaw 16 and is adapted to be gripped by a user. The over-center toggle linkage 38 also includes a stub arm which is pivotably mounted to the lever and a screw 44 which is coupled to the body by threads such that one end 46 of the screw bears on an end of the stub arm to adjust the toggle linkage 38. A release lever 42 is pivoted to the lever or upper handle 14 to contact the stub arm.

The over-center toggle linkage 38 operates in the conventional manner such that a user can close the jaws by bringing the lever or upper handle 14 close to the body or lower handle 12. The over-center toggle linkage 38 locks the lever or top handle 14 in the closed position, and the release lever 42 is used to release the over-center linkage 38.

An extension coil spring 36 is mounted between the body or lower handle 12 and the movable jaw 16 to bias the movable jaw to an open position. The over-center toggle linkage of the preferred embodiment is conventional and is shown in U.S. Pat. No. 4,541,312 and in U.S. Pat. No. 5,351,585, which are incorporated herein by reference.

The gripping jaws 16 and 28 are especially suitable for gripping members, such as wooden planks, framing members or boards, that have a rectangular cross section. The flat or planar lower jaw gripping surface 18 is specifically intended to provide a large surface area to grip one side of a wooden framing member 100 without resulting in any permanent indentations on an exposed surface of the wooden board 100, such as a 2×4.

As shown in FIG. 2, the gripping surface 18 on the lower or fixed jaw 28 is wider than the gripping surface on the upper or movable jaw 16. This flat gripping surface 18 includes a plurality of tangs 22 that are inclined or sloped toward the hinge 32. This orientation of the tangs 22 is chosen so that the locking pliers can be used to grip a member 100 which is suspended from the locking pliers 10 or which extend outward beyond the open end of the jaws 16, 28. The locking pliers also include a hook or loop 30 located on the end of the threaded member 44 and extending from the opposite end of the locking pliers. When a rope is attached to the hook 30, then the locking pliers 10 can be used to hoist a gripped member 100 to an elevated position on a frame structure.

Locking pliers 10 also include a crossbar or rod 20, which in the preferred embodiment has a circular cross section so that the crossbar 20 forms a right circular cylinder. In the preferred embodiment, the crossbar 20 has a length of between 10 and 12 inches and is attached to the flat gripping surface 18 at the center of the crossbar. The crossbar 20 thus extends significantly beyond both sides of the flat gripping surface 18 and both jaws 16, 28. Crossbar 20 extends at right angles relative to the length of the locking pliers 10. Crossbar 20 is relatively rigid so that it can support a load, and in the preferred embodiment comprises a steel rod having a diameter of 0.500 inch. The crossbar 20 is welded to the fixed jaw 28 in the preferred embodiment, but it can be rigidly attached by other conventional means, and it can be disengagable so that the tool can be more easily stored or transported, or so that the locking pliers can be used for other purposes.

As shown in FIG. 1, the crossbar 20 is secured to the fixed jaw 28 so that the flat gripping surface 18 is tangential to the outer surface of the crossbar 20. With the crossbar 20 positioned in this manner, it will abut one edge of a rectangular framing member or workpiece 100 gripped by the jaws 16, 28 of the locking pliers. The crossbar 20 is thus located in a position so that it an be used to align another framing member or workpiece relative to the gripped member 100.

Figure 3:
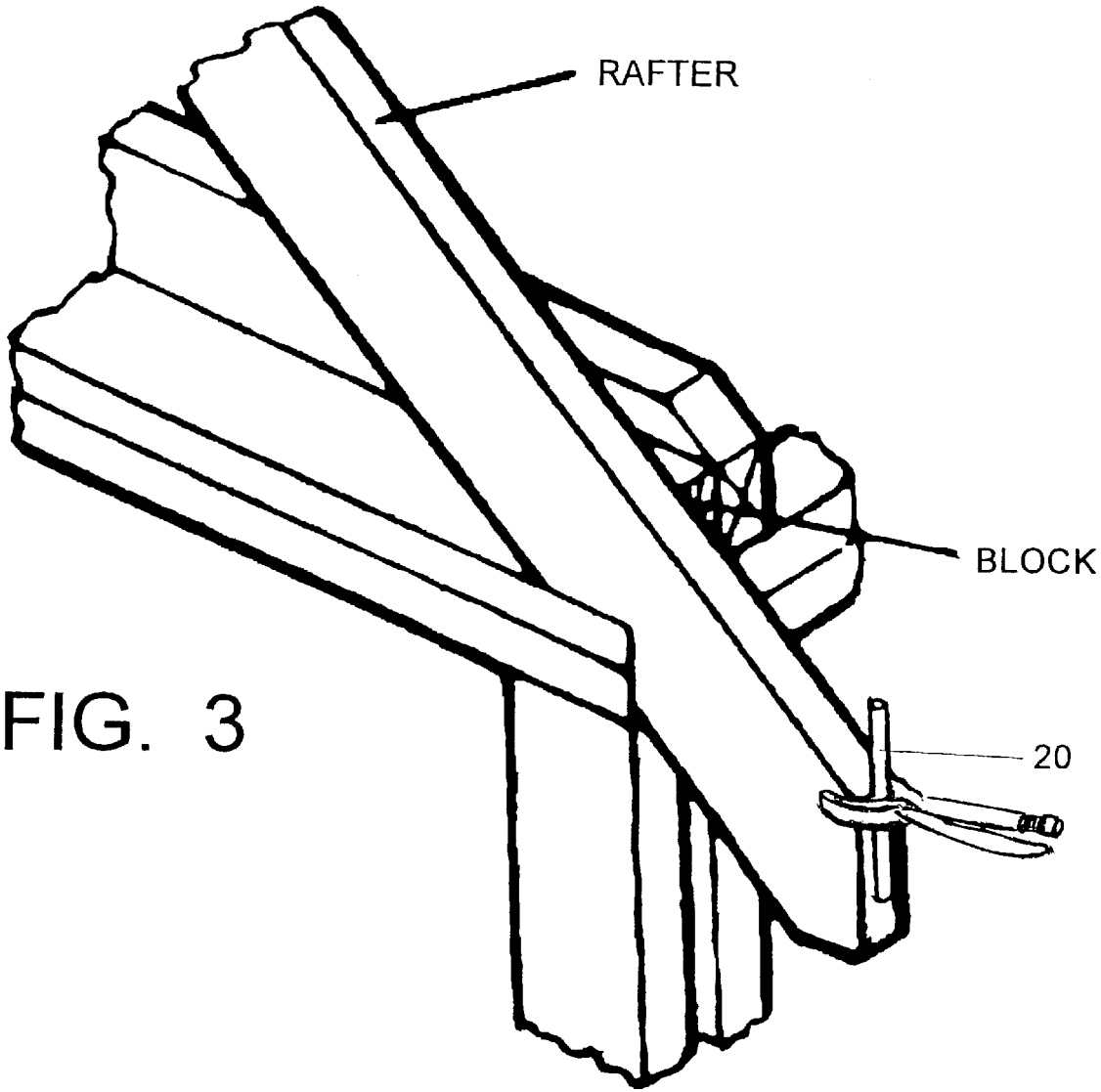
FIG. 3 is a diagrammatic view showing the manner in which the crossbar on the locking pliers can be positioned on the square cut end of a roof rafter so that plywood roof sheathing can be temporarily held in place prior to nailing the sheathing to the rafters.
Figure 4:
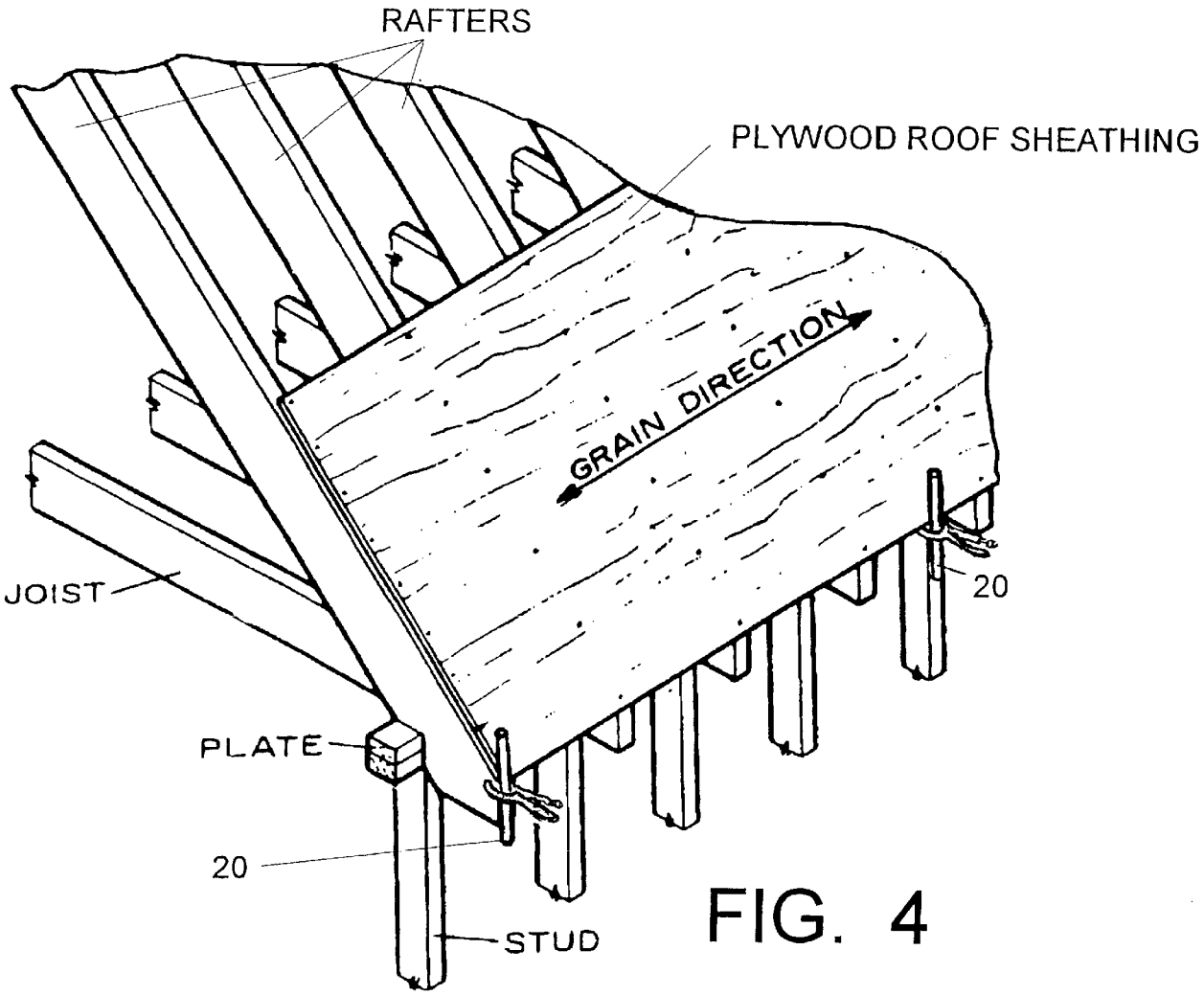
FIG. 4 is a diagrammatic view similar to FIG. 3 showing the plywood roof sheathing in the position in which it would be temporarily supported by crossbars of two locking clamps located on two spaced apart rafters.

FIGS. 3–7 show some of the ways that this tool can be used in performing common construction jobs. Each of these Figures is intended to be representational and some detail has been eliminated. FIGS. 3 and 4 show the manner in which this tool can be employed to position plywood roof sheathing in position so that the sheathing can be nailed to rafters. Locking pliers are first clamped to a vertical distal end of two spaced rafters at the ends of the rafters. The pliers 10 are clamped so that the jaws 16 and 28 grip the sides of the rafter adjacent the vertical end. The flat gripping surface 18 on the lower jaw 28 engages one side so that the round crossbar 20, which is tangent to flat surface 18 will abut the vertical free end and also extend vertically as shown in FIGS. 3 and 4. The crossbar thus extends in the same direction as the end of the rafter. Since the crossbar 20 has a length that is greater than the height of the vertical end of the rafter, the crossbar will extend above the rafter so that it will provide a stop for a plywood roof sheathing panel as shown in FIG. 4. With the two crossbars 20 on separate locking pliers 10 secured to the rafters as shown in FIG. 4, the plywood roof sheathing panel will be properly positioned relative to the rafters and to the roof so that a carpenter can nail the plywood panel in place. It will then not be necessary for an assistant to hold the plywood panel in place while the carpenter nail the plywood to the rafter.

Figure 5:
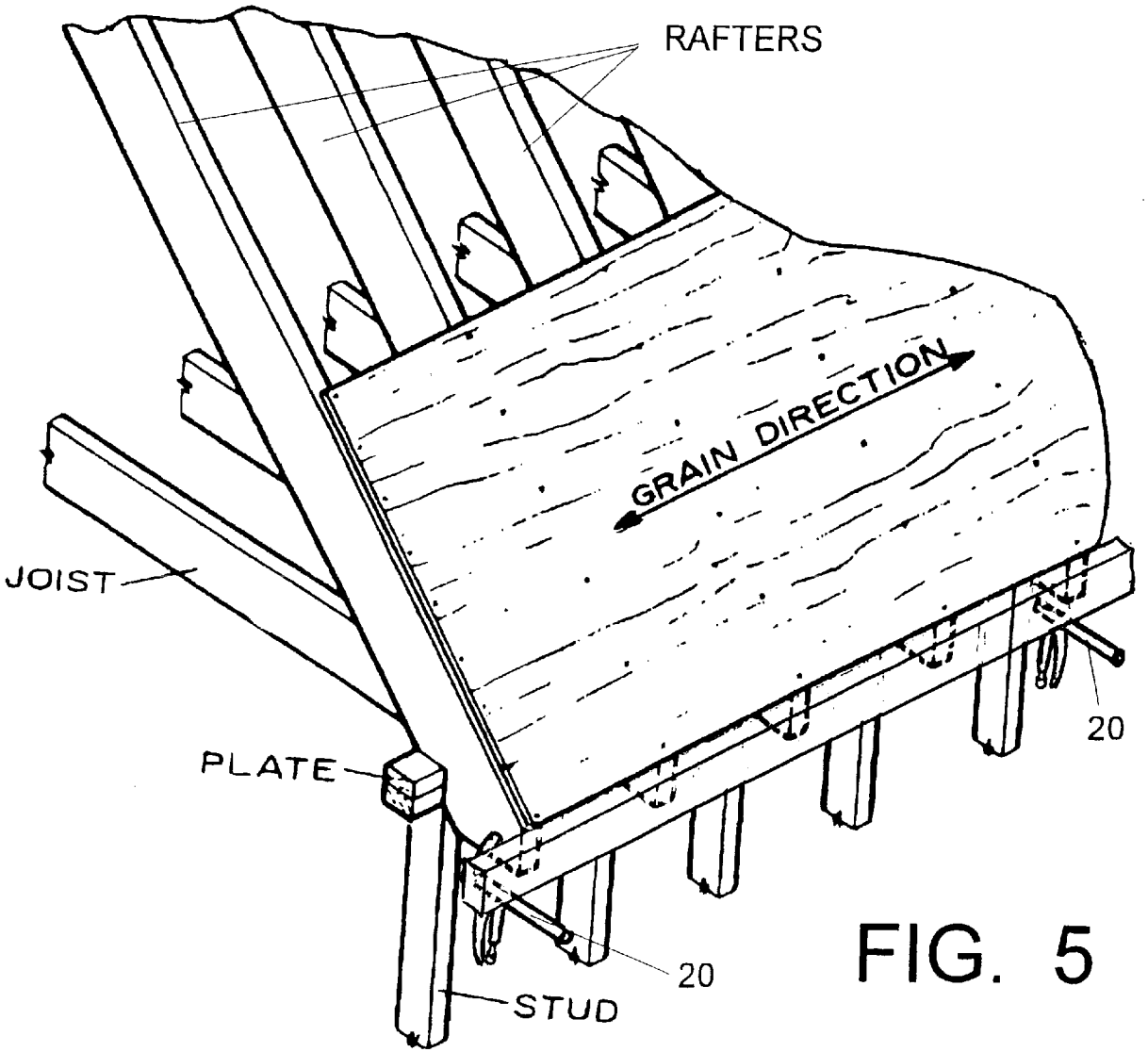
FIG. 5 is another diagrammatic view showing the position of two crossbars in relation to two rafters when the clamp or locking pliers are positioned to support a wood facia to be nailed to the ends of the intervening rafters. Again the other components of the locking pliers are not shown, but the jaws would grip the lower edge of the two rafters when employed in this manner.

FIG. 5 shows the manner in which the crossbar 20 is positioned to enable a carpenter to position the facia on the rafter ends after the plywood roof sheating is in place. As shown in FIG. 5, the crossbar 20 is positioned horizontally so that it will support the bottom edge of a board to be nailed to the vertical ends of the rafters. The locking pliers are attached to the rafters so that the locking jaws 16, 28 will encircle the bottom edge of the corresponding rafter and will grip the vertical sides of the rafter adjacent the vertical rafter end. In this position the locking plier handles 12 and 14 will extend down from the rafters in a generally vertical direction as opposed to the horizontal orientation that the handles would have when used in the manner shown in FIGS. 3 and 4. Another difference in the application shown in FIG. 5 is that the crossbar 20 is not positioned flush with the bottom edge of the rafter, but is instead spaced below the rafter so that sufficient space will be provided for the framing member used to form the facia. If the crossbar is not properly positioned initially, each locking pliers can be easily disengaged to snug up and properly position the facia member.

Figure 6:
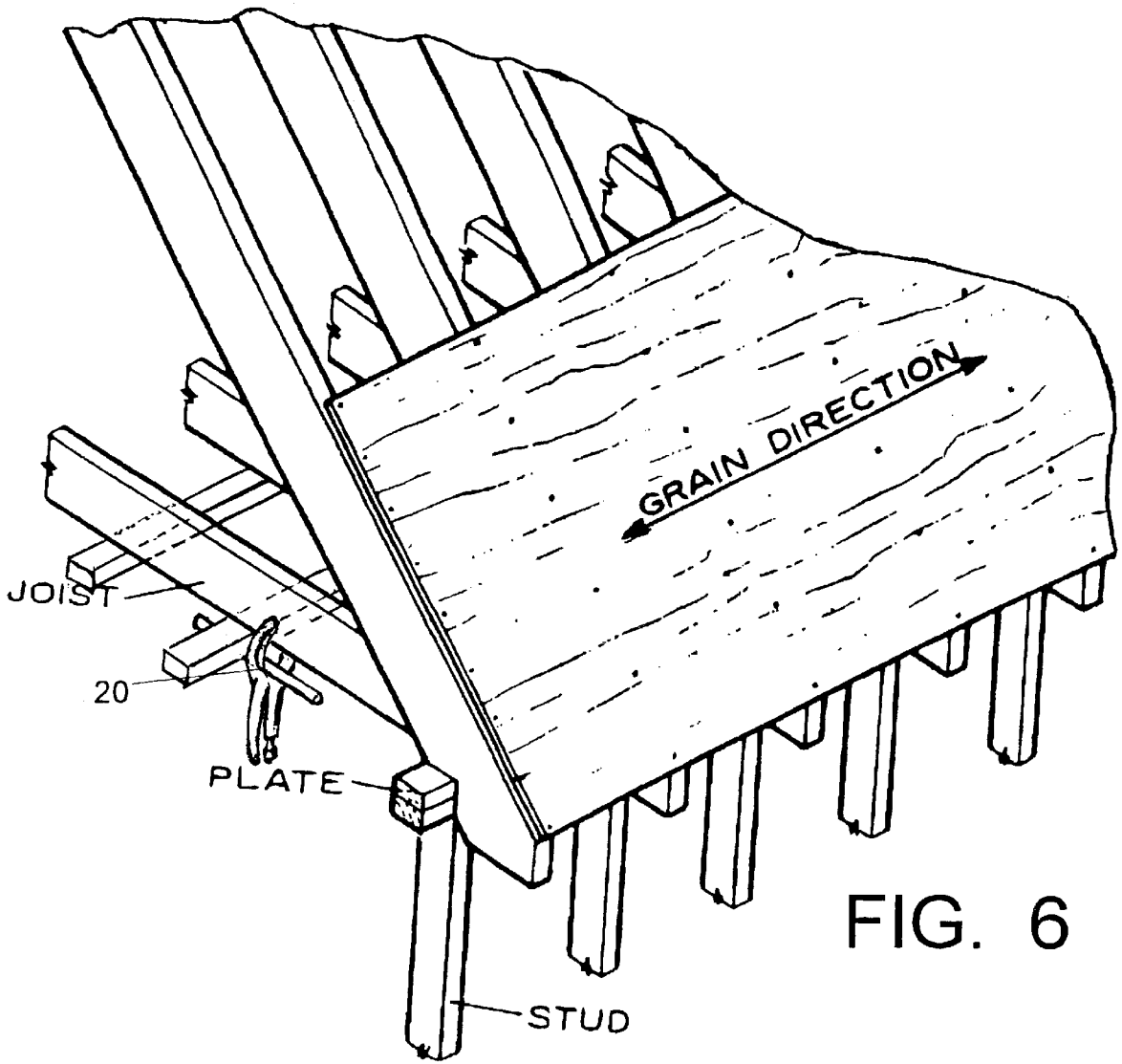
FIG. 6 is also a diagrammatic view showing the position of a crossbar relative to an adjacent joist when the clamp is positioned to support one end of a wooden stringer to be nailed transversely to a plurality of parallel joists. The clamp or locking plier jaws would grip the joist on its lower side as seen in FIG. 6.

FIG. 6 shows a third use for the locking pliers 10. Here the pliers are attached to the joists so that horizontal stringers or firring strips can be nailed to the bottom edge of a series of joists. The locking jaws 16, 18 would be clamped around the lower edge of the corresponding joist in much the same manner in which the locking pliers were attached to the lower edge of the rafter as shown in FIG. 5.

Figure 7:
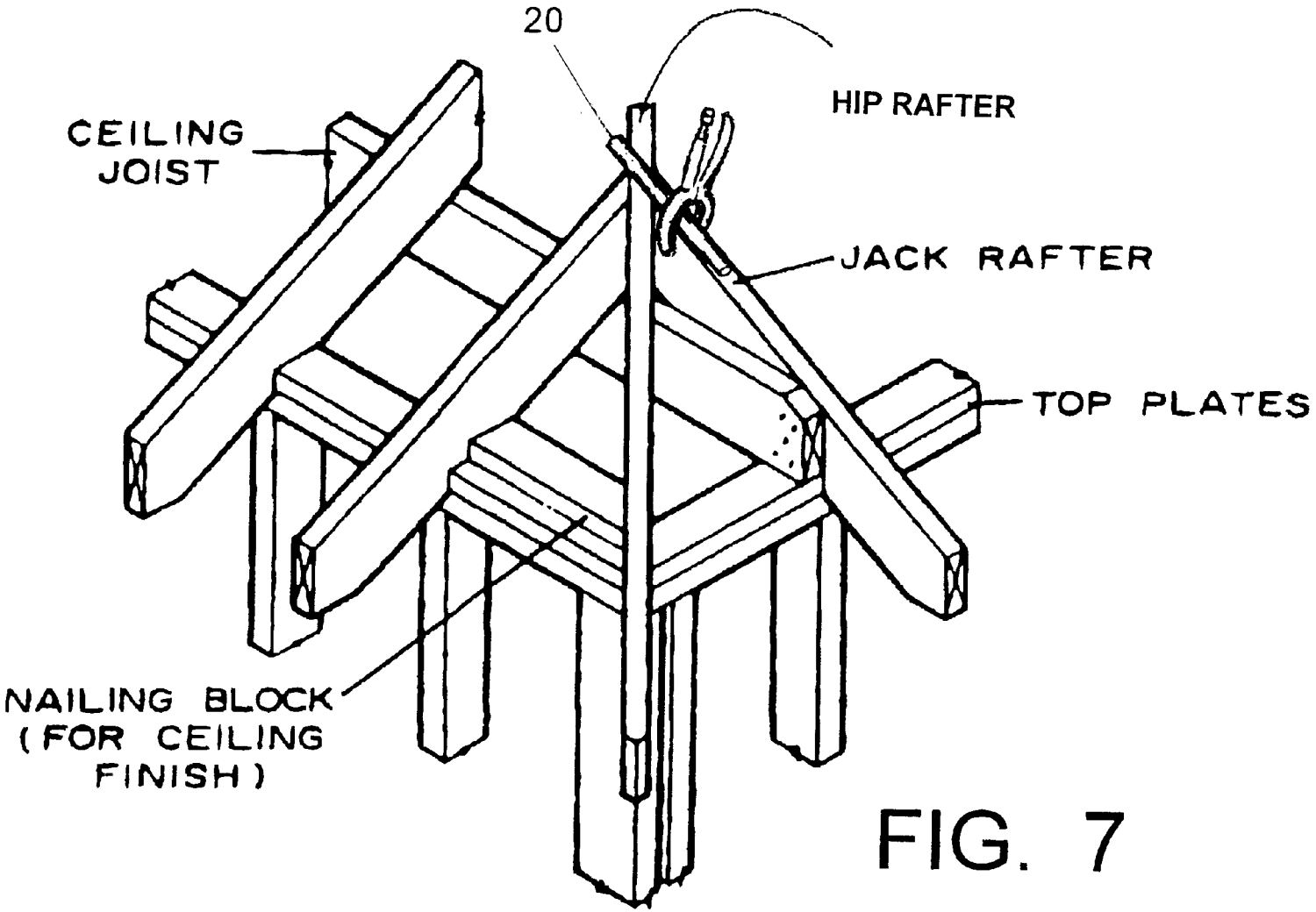
FIG. 7 is a diagrammatic view showing a crossbar positioned to support a jack rafter on top of a hip rafter immediately prior to nailing an angled end of a jack rafter to the hip rafter. The locking plier jaws would grip the top of the jack rafter, in the vicinity of its top edge, when used in this manner.

In the applications shown in FIGS. 3–6, the locking pliers are used to align and support either vertical or horizontal edges of framing member in place prior to nailing. Locking pliers 10 are not restricted to attaching two framing members at right angles. FIG. 7 shows the manner in which the locking pliers 10 with crossbar 20 would be used to position a jack rafter in position to be nailed to a hip rafter. The jack rafter would have a precut edge that would not extend at right angles relative to the upper and lower edge. Instead the end of the jack rafter would be cut at an angle dictated by the inclination or slope of the roof. Locking pliers 10 would be clamped to the top edge of a jack rafter with the locking jaws 16, 28 encircling the jack rafter top edge and with one end of the crossbar 20 extending beyond the end of the jack rafter. The jack rafter would then be positioned abutting the hip rafter with the crossbar 20 extending over the top of the hip rafter. When the jack rafter is positioned relative to the hip rafter in this manner it can then be toenailed in place.

Locking pliers 10 can be used not only to position a jack rafter relative to a hip rafter as shown in FIG. 7, but also to hoist the jack rafter into position. Since the jack rafter is precut, the locking pliers 10 can be secured to the jack rafter on the ground with the crossbar in place as shown in FIG. 7. A rope can be attached to the hook 30, and the jack rafter can then be hoisted up to the roof where the crossbar can be used to position the jack rafter relative to the hip rafter without disengaging the locking pliers 10 from the jack rafter.

Figure 8:
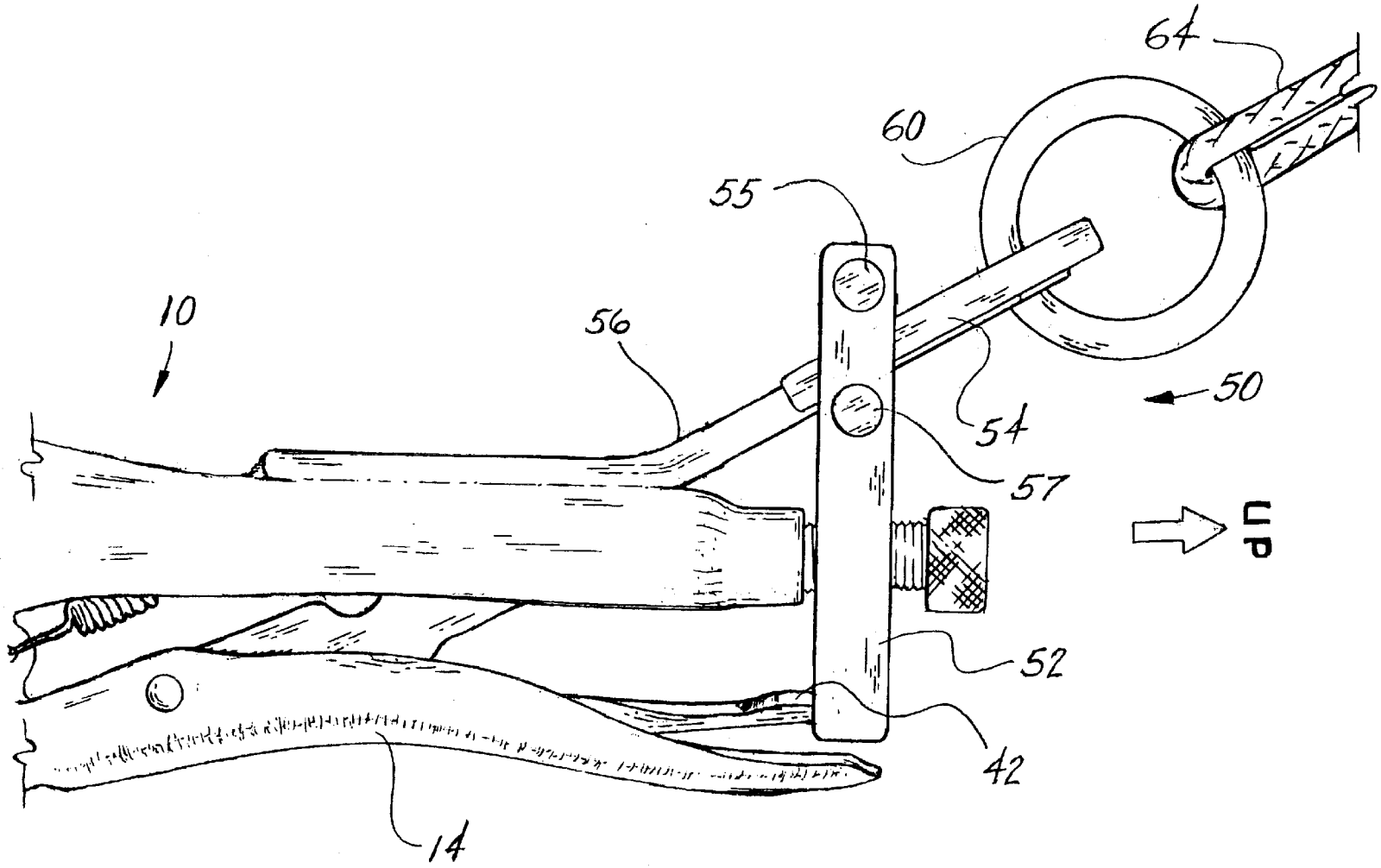
FIG. 8 is a side view of an alternate embodiment of this invention including a safety guard attached to the clamp. The safety guard is shown in its locking position in FIG. 8

A safety guard 50 is employed in an alternate embodiment of this invention in which the locking pliers 10 are used to lift a board or framing member to an elevated position. In the locked position shown in FIG. 8, safety guard 50 prevents inadvertent disengagement of the release clip 42 so that the locking jaws 16 and 28 (the same as shown in FIG. 1) cannot release the member to which they have been attached.

Figure 10:
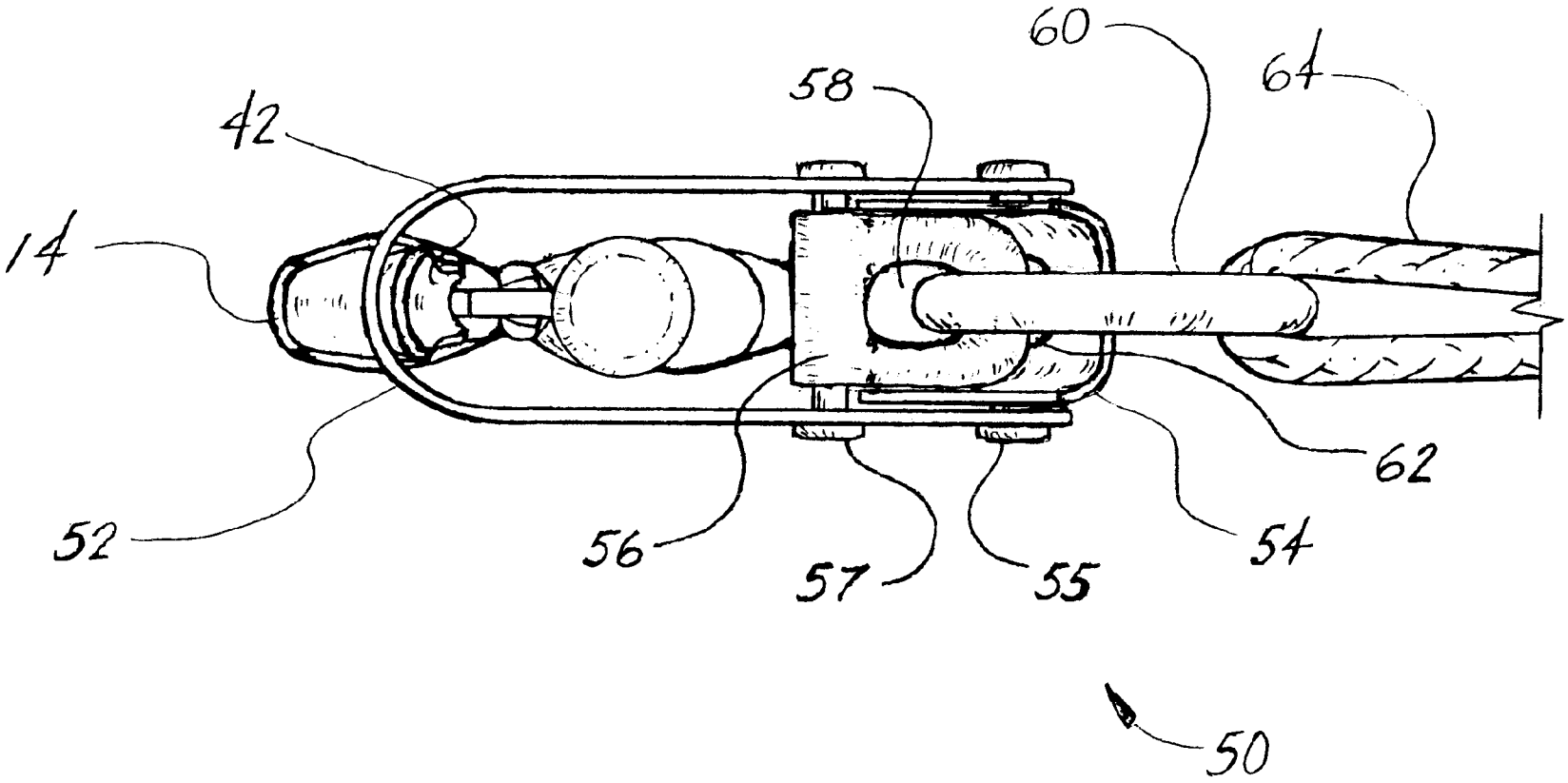
FIG. 10 is another view of the safety guard.

Safety guard 50 includes a U-shaped bail 52 that is rotatable between a locking position in engagement with release clip 42 and a release position in which the bail 52 is clear of the release clip 42. The U-shaped bail 52 can be formed of a thin strip of metal. Bail 52 has a bight or central portion that extends beneath the release clip 42 in the locked position of FIG. 8. As shown in FIG. 10, this central portion is located between two upright and generally parallel arms. The bail 52 is attached to a sleeve 54 at the distal ends of the U-shaped bail by pin 55. The bail 42 is also pivoted about an axis, formed by pin 57 mounted on bracket 56, that is spaced from the bail distal ends. The sleeve 54 is mounted in partial telescoping relationship to a bracket 56 that extends at an angle relative to the lower handle 12. The bracket 56 can be welded to the lower handle 12 or it can comprise and extension of the lower handle. In another alternate embodiment, the bracket can be fastened to the handle by a screw or other fastening means so that the safety guard 50 can be removed when the locking pliers are to used for other purposes.

Figure 9:
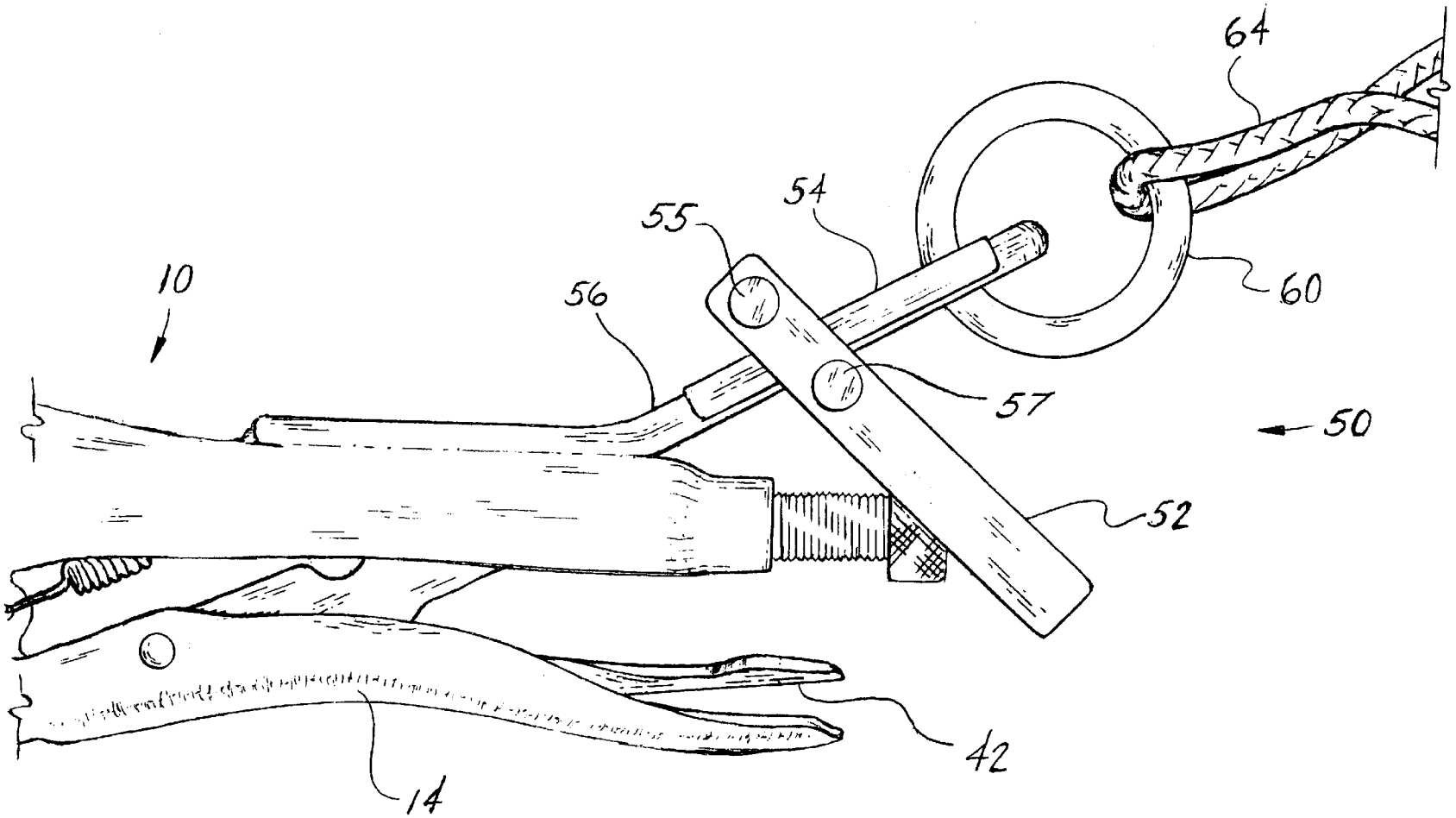
FIG. 9 is a side view of the alternate embodiment of FIG. 8 showing the safety guard in its retracted position.

Bracket 56 includes a slot 58 that extends from a position adjacent the rear end of the bracket 56 toward the lower handle 12. This slot 58 is wide enough to receive a ring 60 a portion of which extends through the slot 58 and which is shiftable in the slot 58 relative to the bracket 56. The ring 60 is also mounted on the sleeve 54, and in the preferred embodiment extends through a hole 62 that is in alignment with the slot 58. In this manner, both the sleeve 54 and the ring 60 can shift within the slot 58 relative to the bracket 56 as the bail 52 moves between the locked and the released positions, shown respectively in FIGS. 8 and 9. The ring 60 also secures the sleeve 54 to the bracket 56.

In use, a rope 64 or a cable, lanyard or other means of raising the locking pliers 10, and the.framing member, gripped and suspended by the pliers 10, is attached to the ring 60. When a tension force is applied to the rope 64, an upward force is exerted on the ring 60 and the sleeve 54 moves upward toward the distal end of the bracket 56. Movement of the sleeve 54 is this direction is limited by engagement of the ring 60 with the end of the slot 58. Since the distal ends of the bail 52 are attached to the sleeve 54 by pin 55, upward or rearward movement of the sleeve 54 causes rotation of the bail 52, about an axis, formed by pin 57, fixed relative to the bracket 56 and the lower pliers handle 12. Upward movement of the sleeve 54 moves the bail 52 into the locking position of FIG. 8 in which the bails encircles the release clip 42 to prevent upward, releasing movement of the release clip 42. When tension is released form the rope 64 and the rope of allowed to slack, the combined weight of the ring 60, the sleeve 54 and a portion of the slackened rope 64 is sufficient to cause movement of the sleeve 54 toward the front or locking jaws 16, 28 to rotate the bail 52 to the released position of FIG. 9. The release clip 42 can then be released in a conventional manner, freeing the framing member or other supported member from the locking pliers 10.

Although especially adapted for use in wood frame building construction, the clamp or locking pliers comprising the preferred embodiment of this invention is not limited to wood or to framing applications. These pliers or clamps can also be modified by one of ordinary skill in the art for other similar applications. Therefore the subject matter of this invention is merely represented by the preferred embodiment and is not so limited. The subject matter is defined instead by the following claims.

I claim:

1. Locking pliers comprising:

a first gripping jaw;

a second gripping jaw;

means for pivoting the first gripping jaw relative to the second gripping jaw;

means for adjustably locking the first gripping jaw relative to the second gripping jaw in a gripping position;

wherein the first gripping jaw includes a curved gripping surface and the second gripping jaw includes a planar gripping surface including protruding tangs inwardly directed for gripping a member between the first and second gripping jaws when the member extends beyond ends of the first and second gripping jaws and a crossbar is located adjacent an inner end of the second gripping member, the crossbar extending transversely relative to the second gripping member and beyond opposite sides of the second gripping member.

2. The locking pliers of claims 1 including a hook member to which a line can be attached so that the locking pliers can be used to hoist the member being gripped.

3. The locking pliers of claim 2 wherein a first handle is attached to the first gripping jaw and a second handle is attached to the second gripping jaw, the hook member being mounted an end of the second handle opposite from the second gripping jaw.

4. The locking pliers of claim 1 wherein the second gripping member is wider than the first gripping member.

5. Pliers comprising:

a first jaw having a first gripping surface;

a second jaw having a second gripping surface opposed to the first gripping surface;

a hinge about which the first jaw is hinged relative to the second jaw; and a release clip holding the first jaw fixed relative to the second jaw when the release clip is in an engaged position and releasing the first jaw relative to the second jaw when the release clip is in a disengaged position, and a safety guard preventing the release clip when moving from the engaged to the disengaged position when the safety guard is in a locked position and permitting movement of the release clip from the engaged to the disengaged position when the safety guard is in a released position, whereby a member supported by the first and second jaws in an engaged position cannot be inadvertently released wherein the safety guard includes a rotatable U-shaped bail that is rotatable into a position overlapping the release clip when the safety guard is in a locking position.

6. The piers of claim 5 wherein the bail is attached to a sleeve that is shiftable relative to a handle to which the second jaw is affixed.

7. The pliers of claim 6 wherein the sleeve is shiftably mounted on a bracket extending from the handle.

8. The pliers of claim 7 wherein the bracket includes a slot and a ring attached to the sleeve extends through the slot, the bail being shiftable into the locked position when the pliers are suspended from a hoisting means attached to the ring, the bail being shiftable to the released position when tension is released-from the hoisting means.

* * * * *